United States Patent [19]

Muto et al.

[11] Patent Number: 4,614,077

[45] Date of Patent: Sep. 30, 1986

[54] AUTOMATIC TIGHTENING METHOD AND APPARATUS

[75] Inventors: Yasutami Muto, Kasukabe; Kiyoshi Kohzuki, Tokyo, both of Japan

[73] Assignee: K.T. Mfg. Co., Ltd., Tokyo, Japan

[21] Appl. No.: 724,108

[22] Filed: Apr. 17, 1985

[51] Int. Cl.[4] ..... B67B 3/20

[52] U.S. Cl. ..... 53/490; 53/331.5; 53/317

[58] Field of Search ..... 53/317, 331, 331.5, 53/490; 173/12; 279/1 R, 111

[56] References Cited

U.S. PATENT DOCUMENTS

| | | | |
|---|---|---|---|
| 3,255,568 | 6/1966 | Martin et al. | 53/331.5 |
| 3,491,516 | 1/1970 | Bergeron | 53/331.5 |
| 3,913,301 | 10/1975 | Keller et al. | 53/331.5 |
| 4,016,938 | 4/1977 | Rice | 173/12 |
| 4,083,270 | 4/1978 | Tomkinson | 173/12 |
| 4,273,198 | 6/1981 | Doniwa | 173/12 |

*Primary Examiner*—John Sipos
*Assistant Examiner*—Donald R. Studebaker
*Attorney, Agent, or Firm*—Parkhurst & Oliff

[57] ABSTRACT

An automatic tightening method comprises the steps of transferring a torque, generated in a driving section for a screw cap through a power transmission joint section to a container, thereby screw-tightening the screw cap in a tightening apparatus for screw-tightening the screw cap by a rotational torque from the driving section, detecting a tightening torque applied to the container, adjusting the driving section or the power transmission joint section when the tightening torque reaches a predetermined tightening torque, and holding the predetermined tightening torque for a predetermined period of time, thereby obtaining the predetermined tightening torque irrespective of the transmitted rotation torque. Also, an apparatus for carrying out the method is disclosed herein.

7 Claims, 5 Drawing Figures

AUTOMATIC TIGHTENING METHOD AND APPARATUS

BACKGROUND OF THE INVENTION

1. Field of the Invention

The present invention relates to an automatic screw cap tightening method for automatically tightening a screw cap to a container for medical supplies, cosmetics, foods or the like, and it relates also to an automatic screw cap tightening apparatus therefor.

2. Description of the Prior Art

In such containers to be provided with screw caps, it is necessary that the screw caps be tightened at a predetermined ideal torque. The reason for this is that, in the case where a tightening or screw torque applied to a container to be closed is smaller than necessary, there is a fear that a screw cap therefor would be loose during the preservation or transportation of the container. Also, in general, the closed container is opened by human hands. In the case where the tightening or screw torque applied to the closed container is larger than necessary, it would be impossible to manually open the container with ease. Also, if the container is tighten by the screw cap at a tightening torque larger than necessary, then the container to be tightened and the screw cap and/or packings or the like attached to the container and the screw cap would be damaged during the tightening operation. Also, the caps to be screw-fitted to the container are made of different materials such as glass, synthetic resin or the like and the tightening torque is varied in accordance with combination of the material. It is therefore necessary that the screw cap be tightened at a tightening torque suitable for material, configuration and size of the container to closed thereby.

More specifically, as shown in FIG. 1, the conventional tightening apparatus is so constructed that a container 1 to be closed is fixed on a container receiving base 2 by a drum portion retainer 3 which is so called a gripper; a closing cap 12 is held stationary by a fastening air chuck 7; the air chuck 7 is coupled to a spindle 8 through a frictional member 9 sandwiched by upper and lower retainer plates 10; and a rotation of the spindle 8 is transmitted to the air chuck 7 through the frictional member 9. Upon tightening the screw cap 12, the frictional member 9 is pressurized by a mechanical force such as an air force, a spring force or the like, and the screw cap is tightened by an inertia of the spindle 8 and the air chuck 7. At this time, when the tightening torque reaches a predetermined value, that is, when its reactive force exceeds a static frictional force between the frictional member 9 and the retainer plates 10, a slippage between the frictional member 9 and the retaining plates 10 will be generated to thereby prevent any tightening torque, above the predetermined value, from being generated. In this case, although the engagement between the frictional member 9 and the retainer plates 10 may be of the dry type, a lubricant oil is frequently injected between the frictional member 9 and the retainer plates 10 in order to avoid a melt-sticking damage. It is, therefore, very difficult to always keep the tightening torque constant due to a change in inertia moment caused by a change, in rotational speed, of the spindle 8, a change in frictional coefficient caused by a temperature change of the frictional member 9, and another change in frictional coefficient caused by a temperature change of the lubricant oil and in accordance with an amount and a kind of the lubricant oil. Thus, it is very difficult to adjust a pressure applied to the frictional member 9 every time the various factors are changed. Also, it is general that such a tightening apparatus is of the multi-head type provided with a plurality of spindles 8, and hence, it is very difficult to adjust the frictional coefficient for the respective frictional members 9.

As described above, the conventional tightening apparatus encounters the serious disadvantages, due to the various factors, that it is difficult to screw-tighten a component, to be screw-tightened, at a constant tightening torque, a tightening torque applied to a component to be closed is varied in a wide range, and it is insufficient to control the tightening torque.

SUMMARY OF THE INVENTION

In view of the above-noted disadvantages, an object of the present invention is to provide an automatic tightening method and an automatic tightening apparatus which may always generate a constant tightening torque upon tightening a component, to be screw-tightened, to a component to be closed, and may eliminate a change in tightening torque among a plurality of spindles even in a multi-head type system having the plurality of spindles.

In order to attain the above-described object, in accordance with the present invention, a tightening method comprises the following steps of: transferring a torque, generated in a driving section for a component to be screw-tightened, through a driving joint section to a component to be closed, thereby screw-tightening the component to be screw-tightened in a tightening apparatus; detecting a tightening torque applied to the component to be closed; adjusting the driving section or the driving joint section when the tightening torque reaches a predetermined tightening torque; and holding the predetermined tightening torque for a predetermined period of time, thereby obtaining the predetermined tightening torque irrespective of the transmitted rotation.

In accordance with the invention for carrying out the automatic tightening method, there is provided a tightening apparatus for screw-tightening a component to be screw-tightened by a rotation from a driving section, the automatic tightening apparatus comprising a driving joint section for transmitting a torque generated in the driving section for the component to be screw-tightened; a torque detector for detecting a tightening torque applied to a component, to be closed by the component to be screw tightened; and means for adjusting the driving section or driving joint section so as to hold the tightening torque at a predetermined tightening torque for a predetermined period of time when the torque detector detects the predetermined tightening torque.

DETAILED DESCRIPTION OF THE PREFERRED EMBODIMENTS

Figure 1:
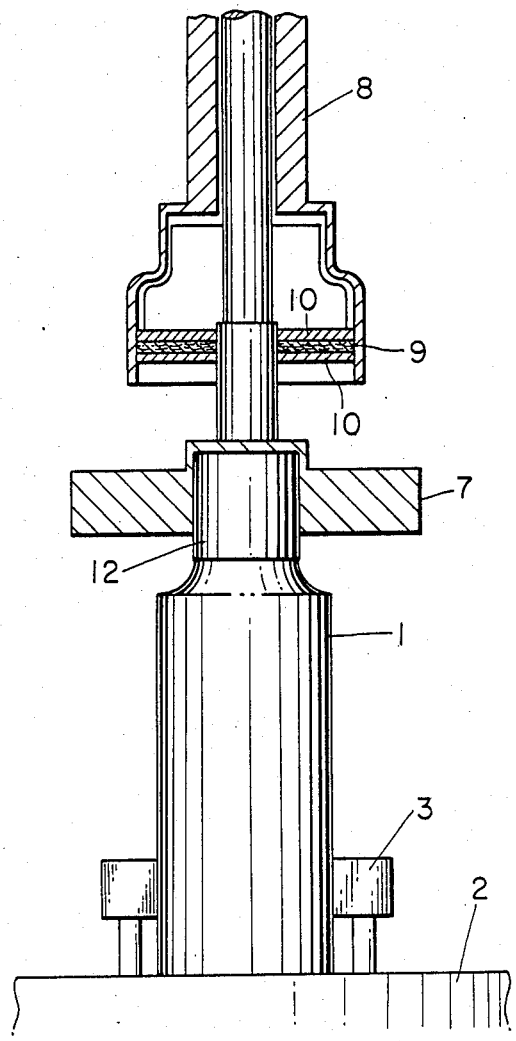
PRIOR ART FIG. 1
FIG. 1 is a cross-sectional view of a conventional tightening apparatus.
Figure 2:
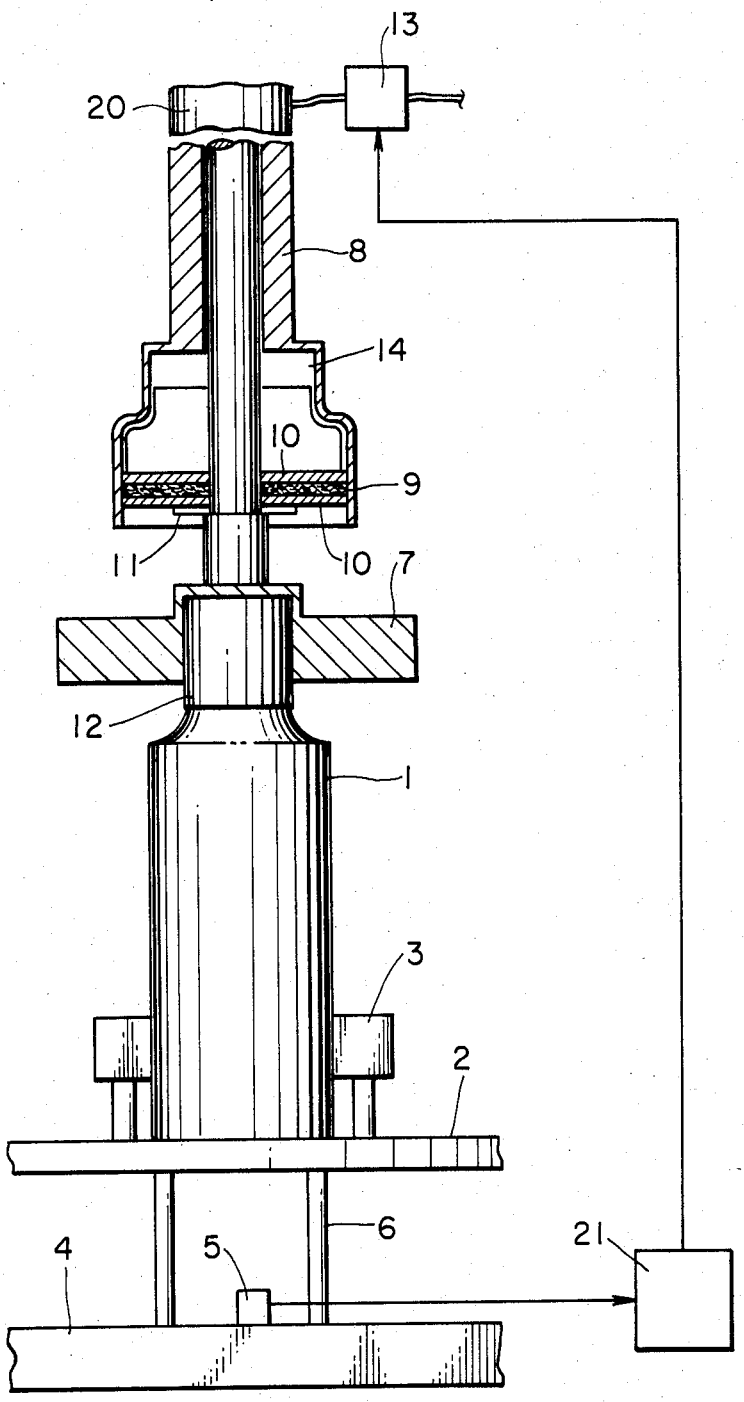
FIG. 2 is a cross-sectional view showing an automatic tightening apparatus in accordance with one embodiment of the present invention.

The present invention will now be described with reference to the accompanying drawings. FIG. 2 is a cross-sectional view of an automatic screw cap tightening apparatus embodying the present invention. A component to be closed, that is, a container 1 is fixed to a container receiving base 2 by a drum portion retainer 3 which is so called a gripper. The container receiving base 2 is fixed through a receiving portion 6 to a tightening machine base 4. Within the receiving portion 6, there is received a torque detector 5 such as a load cell. Fixed to a component to be tightened to the container 1, that is, a screw cap 12 is an air chuck 7 which is a fastening member. The air chuck 7 is coupled to a spindle 8 for transmitting a rotational torque generated from a driving section (not shown), through a power transmission joint section composed of a frictional member 9 sandwiched by retainer plates 10 and a thrust bearing 11. The spindle 8 is moved up and down by an elevating/lowering cam or an air cylinder (not shown), and is normally elevated and lowered upon the screw-tightening operation. An air chamber 14 within the spindle 8 is sealingly supplied with air through an air means 13 and a manifold 20, so that a frictional force is generated between the retainer plates 10 and the frictional member 9, a rotational torque from the driving section is transmitted to the air chuck 7, and the screw cap 12 is tightened to the container 1.

Also, an opening/closing operation of the air means 13 is controlled in accordance with a signal generated out of an adjusting means 21, composed of an amplifier or the like, to which applied is a signal generated out of the torque detector 5 for detecting the tightening torque in the container 1 through the drum portion retainer 3, the container receiving base 2 and the receiving portion 6. The adjusting means 21 may control the tightening torque with a feedback control, and may hold the tightening torque at a predetermined tightening torque for a predetermined period of time.

The spindle 8 is rotated together with the air chuck 7 under the static frictional condition through the frictional member 9 and the retainer plates 10. However, under the condition that the air chuck 7 be held at a standstill, the spindle 8 may be rotated independently in the dynamic frictional state through the frictional member 9 and the retainer plates 10. Also, when the tightening torque is generated, that is, when the air chuck 7 is held at a standstill, the spindle 8 is coupled through the thrust bearing 11 on the retainer plate 10 for the purpose of reducing a load imposed on the driving section. As a result, even under the condition that a load is imposed on the air chuck 7, the spindle 8 may be rotated like a non-load condition.

The operation of the thus constructed automatic tightening apparatus will be explained. Toward the container 1 fixed to the container receiving base 2 by the drum portion retainer 3, the cap 12 fixed to the air chuck 7 is lowered together with the spindle 8 by the elevating/lowering cam and the like, and the spindle 8 is rotated by the driving section to start the tightening operation. First of all, the screw cap 12 is temporarily tightened to the container 1 by inertia forces of the spindle 8 and the air chuck 7 per se. Thereafter, immediately, the air means 13 is opened to sealingly feed air into an interior of the air chamber 14 through the manifold. Then, a pressure is applied to the retainer plates 10 and the tightening of the cap is carried out by the frictional force between the retainer plate 10 and the frictional member 9. At this time, the twist force generated during the tightening of the cap and applied to the container 1 is transmitted to the drum portion retainer 3, to twist the container receiving base 2, so that the twist force is transmitted to the torque detector 5 through the receiving portion 6.

A signal fed from the torque detector 5 is amplified by the amplifier in the adjusting means 21 and is converted into a signal representative of the tightening torque. When the tightening torque reaches the predetermined tightening torque, the signal representative of the tightening torque is fed from the adjusting means 21 to the air means 13, thereby closing the inlet side and keeping constant the pressure in the air chamber 14. For this reason, the pressure applied to the frictional member 9 is kept constant, the tightening torque is kept constant, and the screw cap 12 is tightened to the container 1 at the same tightening torque as the predetermined torque.

The adjusting means 21 applies a signal to the air means 13 in order to keep constant the pressure within the air chamber 14 for the predetermined period of time, and thereafter, applies a signal to the air means in order to open a discharge port of the air means 13 to discharge the air from the air chamber 14. Accordingly, the pressure applied to the frictional member 9 is restored back to the initial state to accomplish the tightening operation, so that the cap 12 is tightened to the container 1 at the same tightening torque as the predetermined torque. In this case, since any fine adjustment of the supply pressure to the air chamber 14 is not necessary at all, it is sufficient that the supply pressure is higher than the pressure applied to the frictional member 9 needed for tightening the screw cap. Also, since the power transmission joint section is not subjected to an influence of the inertia moment of the spindle 8, it is possible to obtain a predetermined tightening torque at any rotational speed of the spindle.

Figure 3:
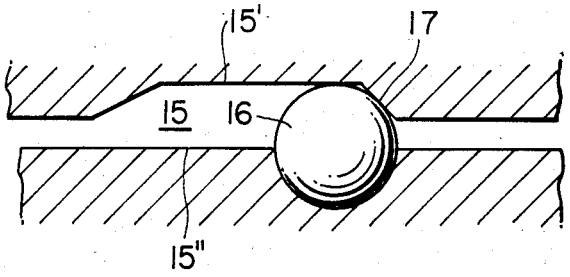
FIG. 3 is a partial cross-sectional view showing a ball clutch of a driving joint section in accordance with another embodiment of the present invention.

In the embodiment described above, the frictional member 9 is used in the power transmission joint section. However, instead thereof, by using a ball clutch 15, it is possible to obtain the same tightening torque as the predetermined tightening torque in the same manner. The ball clutch 15 has a construction shown, in cross-section, in FIG. 3. Some number of balls 16 are equiangularly arranged at some locations between a lower plate 15'' and an upper plate 15' having slant steps 17. When the balls 16 moves along the slant steps 17, the tightening torque may be obtained. For a constant period of time, a larger tightening torque may be generated. Also, if the slant angle of the slant steps I7 of the upper clutch plate 15' is changed, the pressure may be changed so that the tightening torque may also be changed. Therefore, in the same method as in the case where the frictional member 9 is used in the power transmission joint portion, the screw cap 12 may be tightened to the container 1 at the predetermined tightening torque.

Figure 4:
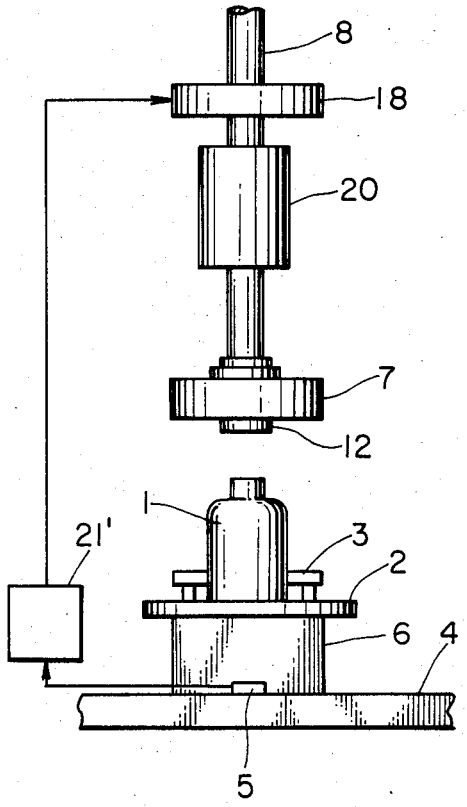
FIG. 4 is a cross-sectional view of an automatic tightening apparatus using a hysteresis clutch in the driving joint section in accordance with still another embodiment of the present invention.

Still another embodiment of the invention will now be explained in which a hysteresis clutch 18 is used in the power transmission joint section as shown in FIG. 4. Although in the foregoing embodiments, the tightening torque is obtained by the air pressure, an adjusted supply current from the adjusting means 21' receiving a signal from the torque detector 5 is fed to the hysteresis clutch 18. Then, a rotational torque from the driving section is transmitted from the spindle 8 to the air chuck 7 through the hysteresis clutch 18 and the manifold 20 for supplying air. The screw cap 12 is tightened to the container 1 in the same manner as in the previous embodiments. First of all, the screw cap 12 is temporarily tightened by the inertia of the spindle 8, the air chuck 7 and the like. Immediately thereafter, an electricity is applied to the hysteresis clutch 18, so that the tightening is started by the pressure action of the hysteresis clutch 18. In the same manner as in the foregoing embodiments, the value of the tightening torque is detected by the torque detector. When the tightening torque reaches the predetermined tightening torque, the adjusting means 21' keeps constant the supply current value to the hysteresis clutch 18, whereby the tightening torque values of the screw cap 12 and the container 1 are held at the same condition. Then, after the supply current to the hysteresis clutch 18 has been held for a constant period of time, the circuit is interrupted to thereby restore the hysteresis clutch 18 back to the non-load condition to finish the tightening. Thus, the screw cap 12 is tightened to the container 1 at the same tightening torque as the predetermined tightening torque.

Figure 5:
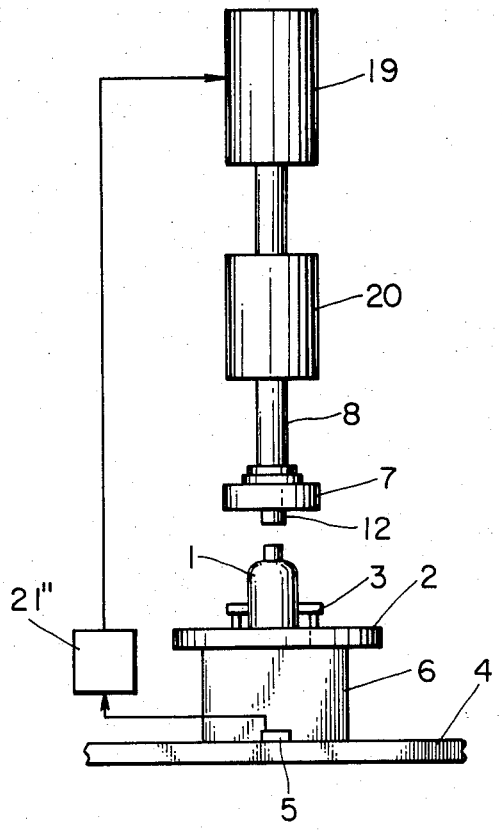
FIG. 5 is a cross-sectional view showing an automatic tightening apparatus using a torque motor in the driving section in order to adjust the tightening torque in accordance with still another embodiment of the present invention.

Still another embodiment will now be described with reference to FIG. 5. Although the power transmission joint section is adjusted in the foregoing embodiments, a torque motor 19 is used as the driving section of the tightening apparatus for adjusting the driving section and the generated torque of the torque motor 19 is increased in proportion to the increase of the supply current value thereto. The tightening torque is increased as the supply current to the torque motor 19 is gradually increased. At this time, the tightening torque transmitted to the container 1 is detected by the torque detector 5, thereby feeding a signal to the adjusting means 21'', adjusting the supply current to the torque motor 19 and holding the supply current when it reaches the predetermined tightening torque. If the circuit including the torque motor 19 is interrupted after the tightening torque has been held for a constant period of time, the torque motor 19 is restored back to the non-load condition to complete the tightening. Therefore, the component to be tightened, that is, the screw cap 12 may be tightened to the component to be closed, that is, the container 1 at the same tightening torque as the predetermined torque in the same manner as in the foregoing embodiments.

Although the case where a single screw cap is tightened has been described in the foregoing embodiments, it is apparent that the present invention may be applied to a multi-head type tightening apparatus which has a plurality of spindles for carrying out a number of tightening operations at once. It is the matter of course that changes in tightening torque of the respective spindles may be eliminated.

As has been described above, in accordance with the present invention, the tightening method includes the steps of transferring a torque, for a component to be tightened, through the power transmission joint section, detecting the tightening torque of a component to be closed by the component to be tightened, adjusting the driving section or the power transmission joint section when the tightening torque reaches the predetermined tightening torque, and holding the predetermined tightening torque for a predetermined period irrespective of the transmitted rotation. Accordingly, the tightening torque may be controlled in a feedback manner without any adverse effect of material of the component to be closed. The component to be tightened may be tightened to the component, to be closed, at a constant predetermined tightening torque irrespective of the change in rotational speed of the spindle. Also, there is no change in tightening condition in different tightening operations. Also, even in the multi-head type tightening apparatus for carrying out a plurality of tightening operations at once, the tightening operations may be always carried out at the constant predetermined tightening torque at the respective heads. Therefore, a change in tightening torque among the respective heads may be eliminated.

We claim:

1. An automatic tightening method for screw tightening a closure component to a container component, the tightening method comprising the steps of: transferring a torque generated in a driving section for the closure component through a power transmission joint section to the container component, thereby screw-tightening the closure component to the container component by a rotational torque from said driving section; detecting a tightening torque applied to the container component; adjusting said driving section or said power transmission joint section when the tightening torque reaches a predetermined tightening torque to terminate an increase in said torque; and holding said predetermined tightening torque for a predetermined period of time, thereby obtaining said predetermined tightening, torque irrespective of the transmitted rotational torque.

2. An automatic tightening method as set forth in claim 1, wherein said screw-tightening is carried out after the closure component has been temporarily tightened to the container component by inertia forces of fastening means.

3. An automatic tightening apparatus for screw-tightening a closure component, by a rotational torque from a driving section, said automatic tightening apparatus comprising a power transmission joint section for transmitting a rotational torque generated in said driving section for the closure component; a torque detector for detecting a tightening torque applied to a container component, to be closed by the closure component; and means for adjusting said driving section or said power transmission joint section to terminate an increase in said torque when a predetermined tightening torque is reached and to hold the tightening torque at said predetermined tightening torque for a predetermined period of time irrespective of the transmitted rotational torque.

4. An automatic tightening apparatus as set forth in claim 3, wherein said power transmission joint section comprises a frictional member, and said adjusting means adjusts a pressure applied to said frictional member, to thereby hold said predetermined tightening torque.

5. An automatic tightening apparatus as set forth in claim 3, wherein said power transmission joint section comprises a ball clutch, and said adjusting means adjusts a pressure applied to said ball clutch, to thereby hold said predetermined tightening torque.

6. An automatic tightening apparatus as set forth in claim 3, wherein said power transmission joint section comprises a hysteresis clutch, and said adjusting means adjusts a voltage and a current supplied to said hysteresis clutch, to thereby hold said predetermined tightening torque.

7. An automatic tightening apparatus as set forth in claim 3, wherein said driving section comprises a torque motor, and said adjusting means adjusts a voltage and a current supplied to said torque motor, to thereby hold said predetermined tightening torque.

* * * * *